US008727229B2

(12) United States Patent
Qi et al.

(10) Patent No.: US 8,727,229 B2
(45) Date of Patent: May 20, 2014

(54) LONGITUDINAL SLEEPER AND DAMPING RAILWAY SYSTEM THEREOF

(75) Inventors: Lin Qi, Jiaozhou (CN); Jing Zeng, Jiaozhou (CN)

(73) Assignee: Qingdao Nianxin Environment Tech Co., Ltd., Jiaozhou, Qingdao, Shandong (CN)

( * ) Notice: Subject to any disclaimer, the term of this patent is extended or adjusted under 35 U.S.C. 154(b) by 0 days.

(21) Appl. No.: 13/519,648

(22) PCT Filed: Jan. 25, 2011

(86) PCT No.: PCT/CN2011/070565
§ 371 (c)(1),
(2), (4) Date: Jul. 27, 2012

(87) PCT Pub. No.: WO2011/095090
PCT Pub. Date: Aug. 11, 2011

(65) Prior Publication Data

US 2012/0286056 A1 Nov. 15, 2012

(30) Foreign Application Priority Data

Feb. 5, 2010 (CN) ..... 2010 1 0111952

(51) Int. Cl.
*E01B 9/14* (2006.01)

(52) U.S. Cl.
USPC ..... 238/85; 238/81; 238/25

(58) Field of Classification Search
USPC ..... 238/23–29, 83–86
See application file for complete search history.

(56) References Cited

U.S. PATENT DOCUMENTS

| | | | | |
|---|---|---|---|---|
| 4,232,822 | A * | 11/1980 | Hahn et al. | 238/7 |
| 5,435,486 | A * | 7/1995 | Gerlach et al. | 238/7 |
| 5,582,346 | A * | 12/1996 | Wakui et al. | 238/25 |
| 5,887,788 | A * | 3/1999 | Wakui et al. | 238/81 |
| 7,641,127 | B2 * | 1/2010 | Markus | 238/2 |
| 7,766,249 | B2 * | 8/2010 | Osler | 238/317 |
| 2008/0265050 | A1 * | 10/2008 | Osler | 238/315 |
| 2012/0286056 | A1 * | 11/2012 | Qi et al. | 238/85 |

FOREIGN PATENT DOCUMENTS

| | | |
|---|---|---|
| CN | 200985478 | 12/2007 |
| CN | 201648880 | 11/2010 |
| GB | 1523672 | 9/1978 |

* cited by examiner

*Primary Examiner* — Jason C Smith
(74) *Attorney, Agent, or Firm* — Volpe and Koenig, P.C.

(57) ABSTRACT

A longitudinal sleeper and a damping railway system thereof are provided. The longitudinal sleeper comprises a pair of longitudinal prestressed concrete beams (1) respectively arranged under rails along a longitudinal direction of the rails, and concrete connection boards (2) transversely connected between the pair of the longitudinal prestressed concrete beams (1).

17 Claims, 5 Drawing Sheets

LONGITUDINAL SLEEPER AND DAMPING RAILWAY SYSTEM THEREOF

This application is a 35 U.S.C. §371 national phase application of PCT/CN2011/070565, which was filed Jan. 25, 2011 and is incorporated herein by reference as if fully set forth.

TECHNICAL FIELD OF THE INVENTION

The present invention generally relates to the field of railway, and more particularly to a longitudinal sleeper. In addition, the present invention relates to a damping railway system comprising the longitudinal sleeper.

BACKGROUND OF THE INVENTION

The railway track usually comprises a track bed (with ballast or without ballast), a sleeper and a rail. The track bed is formed on the subgrade or bridge, the sleeper is laid on the track bed, and the rail is installed on the sleeper.

The material of the sleeper used in the earliest ages is wood, so also called the sleeper wood. The wood has good elasticity and insulation ability, low sensibility to the variation of temperature around, light in weight, easy machining and replacement, and enough displacement resistance. After preservative treatment, the service life of the wood sleeper can be greatly prolonged, may be as long as about 15 years. So 90% of railway in the world was using the wood sleeper. According to the statistics, during the peak period of wood sleeper used, more than 3 billion wood sleepers were laid all over the world, and most of them are pines.

With the decreasing of forest resources and strengthening of people's environment protection consciousness, and also benefit from the great development of science and technology, in the early 1900s, some countries began to produce the steel sleeper and reinforced concrete sleeper to replace the sleeper wood. However, because the steel sleeper consumes a large amount of metal, is expensive and heavy, it is not widely used, only a few countries such as Germany are still using the steel sleeper. Since 1950s, most of the countries in the world began to produce the reinforced concrete sleeper, which has long service life, high stability, low quantities of maintenance, and broken rate and rejection rate being greatly lower than that of the wood sleeper. On a continuous welded rail track (track laid with welded long rails, named due to no seam on a long rail), the stability of reinforced concrete sleeper is improved average 15-20% than that of wood sleeper, so, especially suitable for high speed passenger railway line, such as Japan's Shinkansen, China's high speed dedicated passenger railway line, and Russia's high speed railway line.

However, no matter what the material of sleeper was used, most of railways have adopted the transverse sleeper at present. That is, the sleeper is laid transversely along the track or rail. This transverse sleeper has many disadvantages and shortages.

The transverse sleeper is laid separately on the track bed, so it is unfavorable for distribution of load from rail. When a train passing, under the impact of wheels, the sleeper shall suffer high impact load, easily cause damages to track bed underneath, such as ballast broken, and displacement, thus after a long period of using, the rail may deform and cause the traveling of train vibrated and swayed, give serious and adverse influences to the train running stability and riding comfortability. On the contrary, the train vibration and swaying will speed up the worsening of railway conditions.

The railway maintenance is a kind of hard labor. If the railway track deformed (mainly the deformation of rail), or concrete sleeper fractured, a great amount of resources shall be paid for correcting the deformation of rail, or repairing the fracture of concrete sleeper. In addition, it requires frequent maintenance for ballast broken or displaced.

Recently, to overcome such many defects and shortage of traditional transverse sleeper, it has been put forward a longitudinal sleeper (also called "trapezoidal sleeper" or "ladder-type sleeper" in some documents), this longitudinal sleeper comprises both parallel longitudinal prestressed concrete beams laid longitudinal along a railway, and a steel pipe connecting between both longitudinal beams.

As an example, CN1135279C discloses a typical longitudinal sleeper (or trapezoidal sleeper), which comprises a pair of longitudinal beams made of prestressed concrete, two rails respectively arranged longitudinally on the pair of longitudinal beams; and a plurality of steel pipes used as connectors being arranged along the rail horizontally in the specified spacing, for connecting the pair of longitudinal beams and keeping the rail gauge. The longitudinal beam has the internal pre-tensioned rebar to increase the strength of the longitudinal prestressed concrete beam, and prevent its fracture. Both ends of the steel pipe are respectively preburied in the pair of longitudinal beams, and intersected with the rebar in the longitudinal beam. The longitudinal prestressed concrete beam is preburied with a plurality of fasteners (usually sleeves) for installing the rail onto the sleeper by interconnecting between the fasteners and clamping pieces. To prevent the steel pipe turning or displacing between the longitudinal prestressed concrete beams, both ends of the connector (i.e., steel pipe) is provided with a rib being radially projected to transfer the torsion of the connector to the concrete. These ribs still have small ribs on top and bottom surfaces to transfer the transverse force from the connector to the concrete.

In the aforesaid type of longitudinal sleeper, because the longitudinal beams are continuously arranged longitudinally along the rail, so greatly improve the distribution of train loads, effectively control the deformation of rail, greatly save the railway maintenance cost.

In addition, CN1167183A also relates to a longitudinal sleeper, which mainly improves the end of the steel pipe for connection with the longitudinal beam, that is, makes the end into flat shape, thus prevent the turning and withdrawing of the steel pipe through a simple structure (no rib and the like required). In addition, filling concrete into the steel pipe may increase its bending strength.

Obviously, compared with the traditional transverse sleeper, the above mentioned longitudinal sleeper has many advantages. However, the prior longitudinal sleeper still has some shortages. For example, the steel pipe for connection with a pair of longitudinal beams may interfere with the electrical signal of a train. In addition, if exposed outside for a long period of time, the protective paint on the surface of the steel pipe may be peeled off and then the pipe may be eroded. In order to protect the paint from being peeled off, some protective measures should be taken during the transportation and construction, thus the transportation and construction difficulty shall be increased, and so the labor for maintenance and cost. So, it is necessary to improve the prior longitudinal sleeper.

SUMMARY OF THE INVENTION

An object of the present invention is to provide an improved longitudinal sleeper, which may at least solve the problems such as the steel pipe as the connector in the prior longitudinal sleeper may interfere with electrical signal and may be eroded during long-period exposure.

Another object of the present invention is to provide a damping railway system comprising the longitudinal sleeper thereof.

To realize the object of the present invention, according to one aspect of the present invention, there is provided a longitudinal sleeper comprising a pair of longitudinal prestressed concrete beams respectively to be positioned longitudinally under a rail. The longitudinal sleeper further comprises a concrete connection board connected transversely between the pair of longitudinal prestressed concrete beams.

In the present invention, since the prior steel pipe between the longitudinal prestressed concrete beams is replaced by the concrete connection board as a connector, the problem that the steel pipe will interfere with the electrical signal and will be eroded due to long-period exposure can be thoroughly solved.

According to a preferred embodiment, the pair of longitudinal prestressed concrete beams and the concrete connection board may be formed integrally by pouring, for example, integrally poured in a factory, so it is easy to manufacture, with high production efficiency, and favorable for construction. For the prior steel pipe type connector, when making the longitudinal sleeper, the connection between the steel pipe and the longitudinal prestressed concrete beam must be considered, meanwhile the prevention against turning and displacement between the steel pipe and the longitudinal prestressed concrete beam should be also considered. In this embodiment, because the longitudinal prestressed concrete beam and the concrete connection board are poured or cast integrally, so many problems about interconnection may be not considered, and the longitudinal sleeper is simple in structure, easy to be manufactured, and can effectively reduce the manufacture cost.

According to a preferred embodiment, a plurality of concrete connection boards may be arranged at an interval along the length of the longitudinal prestressed concrete beam. For example, for a 6 m long longitudinal sleeper, three concrete connection boards may be arranged between a pair of longitudinal prestressed concrete beams to improve the structural stability and operating reliability of the longitudinal sleeper. As required, one or two concrete connection boards may be arranged between the longitudinal prestressed concrete beams, or more than three concrete connection boards arranged, the detailed quantity of the connection boards is not limited in the present invention.

According to a preferred embodiment, the longitudinal sleeper as a whole may be symmetrically arranged relative to the center line of its length direction, thus ensure its load bearing balanced, and improve its structural stability and operating reliability.

According to a preferred embodiment, the longitudinal prestressed concrete beam is provided therein with an embedded sleeve extended downward from its upper surface, and a through-hole continuously extended from the bottom of the embedded sleeve downward to the outside of the longitudinal prestressed concrete beam.

In the prior longitudinal sleeper, for example, disclosed by CN1135279C, the preburied sleeves are arranged in the longitudinal prestressed concrete beam for fixing the fasteners, so that the rail may be installed onto the longitudinal beam to form the track. However, due to the difference of thermal expansion coefficients between the material of the preburied sleeve and the concrete of the longitudinal beam, so when used under high and low air temperature, the temperature stress shall give a great effect, which may cause the longitudinal prestressed concrete beam fractured and damaged, especially in the region with high air temperature change. For example, in Beijing, the maximum temperature of the railway may reach up to 62, but its minimum temperature may reach to −22, which may cause hidden trouble for the longitudinal sleeper, and increase the maintenance cost of the track. Moreover, during long-term using, foreign matters and water accumulation shall be found in the preburied sleeve, which may occupy the space for thermal expansion and contraction stress relieving, so increase the stress of the longitudinal prestressed concrete beam and cause the sleeper fractured.

In the preferred embodiment of the present invention, by arrangement of through-holes in the longitudinal prestressed concrete beam, let the bottom of preburied sleeve interlinked with the outside of the longitudinal beam to relieve the stress, so avoid the arising of the above mentioned fracture and damages. In addition, all foreign matters and water accumulation inside the preburied sleeve may be drained outside of the longitudinal prestressed concrete beam through this through-hole, so it may avoid the accumulation of foreign matters and water accumulation in the longitudinal prestressed concrete beam, effectively protect the longitudinal prestressed concrete beam against fracture and damages.

The present invention does not intend to limit the form and quantity of the through-hole, as long as to meet the purpose of the present invention, that is, being able to relieve the stress in the longitudinal prestressed concrete beam, drain the foreign matters and water accumulation in the preburied sleeve out of the longitudinal prestressed concrete beam. As an example, the through-hole may vertically extend downward from the preburied sleeve to the lower surface of longitudinal prestressed concrete beam, so all foreign matters and water accumulation in the longitudinal prestressed concrete beam from the preburied sleeve may be drained out through this through-hole under the gravity effect. As an another example, the through-hole may be inclined and extended downward from the lower part of the preburied sleeve to the side surface of the longitudinal prestressed concrete beam, thus introduce the foreign matters in the preburied sleeve to the side surface of the longitudinal prestressed concrete beam, for instance between a pair of longitudinal prestressed concrete beams or outside of the longitudinal sleeper.

According to a preferred embodiment, the diameter of the through-hole may be gradually enlarged outward, which is favorable for making the longitudinal prestressed concrete beam, that is, after the pouring or casting process of the sleeper, the core for forming the through-hole can be easily withdrawn from the through-hole.

According to a preferred embodiment, in order to successfully drain out the foreign matters and water accumulation in the preburied sleeve, the outlet of the through-hole extended out of the longitudinal prestressed concrete beam shall be unblocked. For example, when the outlet of the through-hole locates on the lower surface of the longitudinal beam, its location may be spaced apart with a specified distance from the track bed or bearing, because the longitudinal sleeper is a float-type, this requirement can be easily met. For example, a shock-absorbing pad or damper can be disposed around the outlet; or a small hole may be opened at the corresponding position on the shock-absorbing pad, which will substantially not affect the performances of the shock-absorbing pad. If the outlet of the through-hole locates at the inner surface of the longitudinal beam, usually no special treatment required, because the inner surface is usually exposed outside directly. If the outlet of the through-hole locates at the outer surface of longitudinal beam, usually no special treatment required, because this outer surface is also directly exposed outside; if the concrete bearing or cast-iron bearing etc are also arranged out of the longitudinal beam, then the outlet must be spaced apart with a specified distance from this bearing.

When dismantling mould during the production of the sleeper, a stress concentration may be produced between the longitudinal prestressed concrete beam and the concrete connection board (especially at the connection corner), thus cause the arising of crack. In addition, in a ballast track bed system, a stress may be produced in the longitudinal prestressed concrete beam and the concrete connection board due to friction of ballast and non-uniform support of ballast, which may also cause the crack at the joint portion between the longitudinal beam and the connection board. According to a preferred embodiment, in order to meet the requirements of the ballastless track system for high speed train running, a rounded corner may be formed at the connection corner between both sides of the concrete connection board and the longitudinal prestressed concrete beam, that is, to form a round corner transition, so as to avoid the arising of crack due to stress concentration at this connection corner.

Moreover, according to a preferred embodiment, at least a pair of reinforcement rebars may be symmetrically arranged in the concrete connection board at both sides of the center line, both ends of which are respectively extended into the longitudinal prestressed concrete beam and bent outward relative to the center line and extended for a specified length. In this embodiment, through bending both ends of the reinforcement rebar outward, the tensile strength of the reinforcement rebar may be improved. In addition, the longitudinal prestressed concrete beam may have the internal connecting rebar for connecting a pair of the reinforcement rebar, thus further improve the tensile strength of the reinforcement rebar.

According to a preferred embodiment, during production, a stress release crack may be formed in advance at the place close to the joint portion between a pair of longitudinal prestressed concrete beam and the concrete connection board (such as the corner of connection) to lead and release the stress, thus avoid arising of cracks being unable to repair and uneasy repairing, so as to control the generation of crack.

According to a preferred embodiment, the stress release crack may be formed on both top surface and/or bottom surface of the longitudinal prestressed concrete beam, but not fractured to the extent of damaging the longitudinal sleeper, that is, basically give no influences to the quality of the longitudinal prestressed concrete beams, no adverse influences to rail on the longitudinal beam. The stress release crack is preferred to form in the lower surface of the longitudinal prestressed concrete beam, because of no direct contact with rail.

In the present invention, various methods may be used for forming the above stress release crack. According to a preferred embodiment, several structural rebars may be arranged in the concrete connection board. For example, at least a pair of structural rebars arranged in the concrete connection board, and symmetrically arranged along both sides of the center line of the concrete connection board. Both ends of the structural rebar may be respectively extended to the place close to the boundary between the concrete connection board and the concrete longitudinal beam, thus produce stress nearby both ends. Moreover, the stress is usually aroused at the connection corner between the concrete connection board and the concrete longitudinal beam, so the stress release crack may be formed from the connection corner between the concrete connection board and the concrete longitudinal beam to the center line of the connection board. According to a preferred embodiment, at least a pair of post-tensioned rebars may be symmetrically arranged along both sides of the center line of the concrete connection board, with both ends respectively extended to the outside surface of the pair of longitudinal prestressed concrete beams. To avoid the stress release crack being aroused on the longitudinal prestressed concrete beam continuously fractured, a kind of post-tensioned rebars are arranged in the concrete connection board and the longitudinal prestressed concrete beam at its both ends, that is, control the stress release crack through the post-tensioned stress, enable it keep in a closed state. In details, after the longitudinal sleeper is demoulded, conduct the tensioning operation for the post-tensioned rebar to keep the stress release crack in a closed state and no continuous fracture. Through this embodiment, on one hand, the location of the fracture can be effectively controlled, avoid the fracture being occur at adverse positions, and the stress produced during manufacture can be released out, on the other hand, the stress produced during operation due to friction and non-uniform support etc, can be immediately released, meanwhile, by acting of the post-tensioned rebar, it may be also recovered to the non-fractured state, thus effectively avoid the fracture of the longitudinal prestressed concrete beam, prolong the service life of rail and improve the running safety.

To effectively prevent the continuous fracture of the stress release crack, always keep it in a closed state, the post-tensioned rebar is preferred at the inner side of the structural rebar.

To prevent the fracture occurring at the connection corner between the concrete connection board and the longitudinal prestressed concrete beam due to stress concentration, at least a pair of crack resistant auxiliary rebar may be also symmetrically arranged at the inner side of the connection corner along both sides of the center line of the concrete connection board, inclined and arranged relative to the center line. As an embodiment, the inclined angle between the pair of crack resistant auxiliary rebar and the center line may be 30° to 60°.

According to another aspect of the present invention, there is provided a damping railway system comprising the present longitudinal sleeper, so at least it may have all advantages of the longitudinal sleeper.

According to an embodiment, the damping railway system comprises the rail installed onto the longitudinal prestressed concrete beam in the longitudinal sleeper along the length direction, which means the length direction of the damping railway system, and also the length direction of the longitudinal prestressed concrete beam and rail, because the present sleeper is a "longitudinal sleeper". Usually, by joint of fastener with the preburied sleeve in the longitudinal prestressed concrete beam, the rail can be installed onto the longitudinal prestressed concrete beam.

According to an embodiment, the damping railway system may comprise a bearing; the longitudinal prestressed concrete beam is installed onto the bearing. The bearing, for example, may be a L-shaped concrete bearing, or a cast-iron bearing. As a preferred embodiment, the bearing may be formed into L-shape with bottom part and side part, namely L-shape bearing. The longitudinal prestressed concrete beam sits on the bottom part of the bearing, and the side of the sleeper is leaned against the side part of the bearing. Through this L-shape concrete bearing, it may not only support the longitudinal prestressed concrete beam, but also realize the limitation and climb-prevention of the longitudinal sleeper or the damping railway system.

According to a preferred embodiment, a shock-absorbing pad or damper may be arranged between the longitudinal prestressed concrete beam and the bottom part of the bearing, and a buffer pad arranged between the longitudinal prestressed concrete beam and the side part of the bearing to realize the shock absorbing and buffering, reduce the shock propagation from rail system to structures, meanwhile, exert the dispersion of impact load by longitudinal sleeper, improve the train's ride comfortability and prolong the service life of rail. The shock-absorbing pad and buffer pad may be made of several elastic materials, for example rubber, spring, and plastic. Various existing qualified dampers may be applicable.

According to a preferred embodiment, a pier is disposed at the inner side of the longitudinal prestressed concrete beam, spaced apart from the beam, and abuts against the concrete connection board. Through the pier, the longitudinal limitation (i.e., climb-preventing) for the longitudinal sleeper may be realized. A gap is left or a buffer pad is disposed between the pier and the longitudinal prestressed concrete beam, so as to avoid transferring of the vibration from the longitudinal prestressed concrete beam to the pier. Moreover, since the pier is arranged inside the longitudinal prestressed concrete beam, it is convenient to construct the damping railway system in such a place where the outside area of the railway system is limited, such as tunnel and bridge. Here, the pier may be cast-in-place. A buffer pad may be also arranged between the concrete connection board and the pier, the buffer pad may be made of elastic material.

For all above, the longitudinal sleeper and damping railway system mainly include but not limited the following advantages:

1. Because a concrete connection board is used as the connector between a pair of longitudinal prestressed concrete beams, the problem in relation to a steel pipe used in the prior art can be thoroughly solved, such as the steel pipe will interfere with the electrical signal of a train, the steel pipe will be eroded due to long-period exposure, and the maintenance cost will be increased;

2. Because both concrete connection board and longitudinal prestressed concrete beam may be poured integrally, it is simple in structure, easy to be manufactured, and has high production efficiency, etc.;

3. Because the longitudinal prestressed concrete beam has the internal through-hole extended from the bottom of the preburied sleeve downward to the outside of the longitudinal prestressed concrete beam, the stress aroused in the longitudinal prestressed concrete beam due to different linear expansion between preburied sleeve and concrete may be relieved, and also avoid the foreign matters and water accumulation in the longitudinal prestressed concrete beam, and protect the longitudinal beam against fracture and damages;

4. By arrangement of a shock-absorbing pad and a buffer pad between the longitudinal prestressed concrete beam and both bottom part and side part of the bearing, a damping railway system may be provided, which has damping function, improve the train running stability and riding comfortability, meanwhile reduce the damages to the sleeper and track bed etc from the impact energy of a train;

5. By presetting a stress release crack on the longitudinal prestressed concrete beam, the problem of the stress release of the concrete longitudinal beam can be resolved. Through adding post-tensioned rebars, keep the stress release crack in a closed state to eliminate the adverse influences from stress release crack, meanwhile, prevent the arising of crack during the later operation, thus effectively prolong the service life of longitudinal sleeper and damping railway system, and reduce the maintenance cost;

6. A rounded corner formed at the connection corner between concrete connection board and longitudinal prestressed concrete beam may avoid fracture due to stress concentration hereof. The arrangement of reinforcement rebars in the concrete connection board and both ends bent outward may not only increase the strength and rigidity of the concrete connection board, but also increase its tensile strength, and avoid stress concentration in longitudinal prestressed concrete beam;

7. The pier is arranged inside and spaced apart from the longitudinal prestressed concrete beam, so as to provide the longitudinal limitation for the longitudinal sleeper, that is, climb-preventing function, and favorable for laying the longitudinal sleeper at the restrictive area outside thereof.

It should be especially noted that in different embodiments of this invention, all above characteristics may be either used individually or in any combinations (once the combination is possible or compatible), thus all embodiments shall fall into the protection scope of this invention. To avoid any unnecessary details, this invention shall give no details about various possible combinations.

DETAILED DESCRIPTION OF THE PREFERRED EMBODIMENTS

Refer to the attached figures, now the embodiments of the present invention shall be described in details as followings.

First, refer to FIG. 1 to FIG. 9 to describe the longitudinal sleepers of various embodiments.

Figure 1:
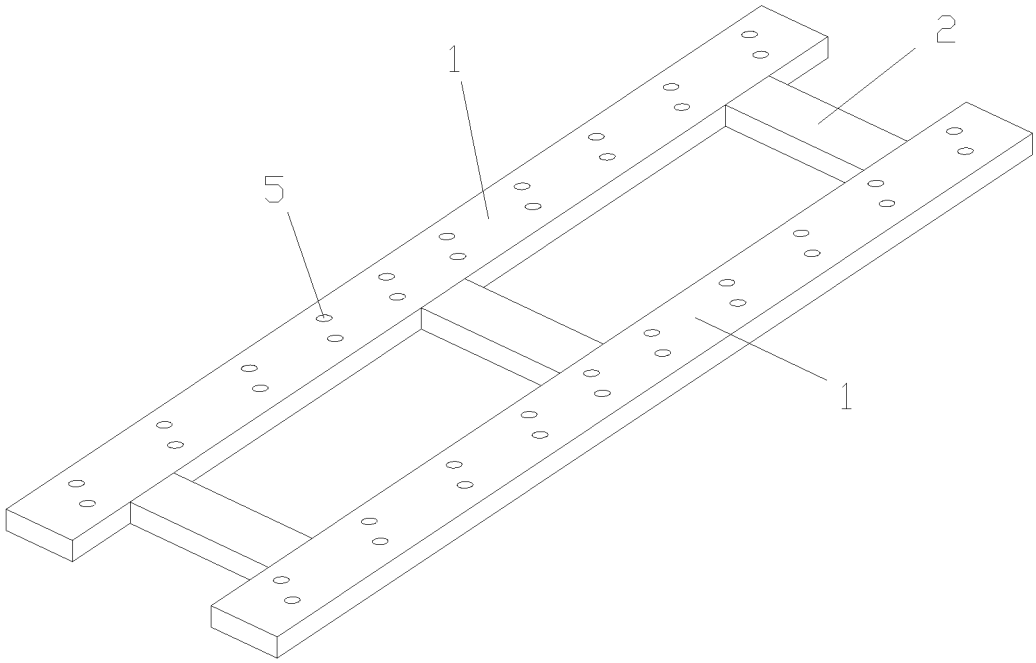
FIG. 1 is the illustration of a longitudinal sleeper according to an embodiment of the present invention.
Figure 2:
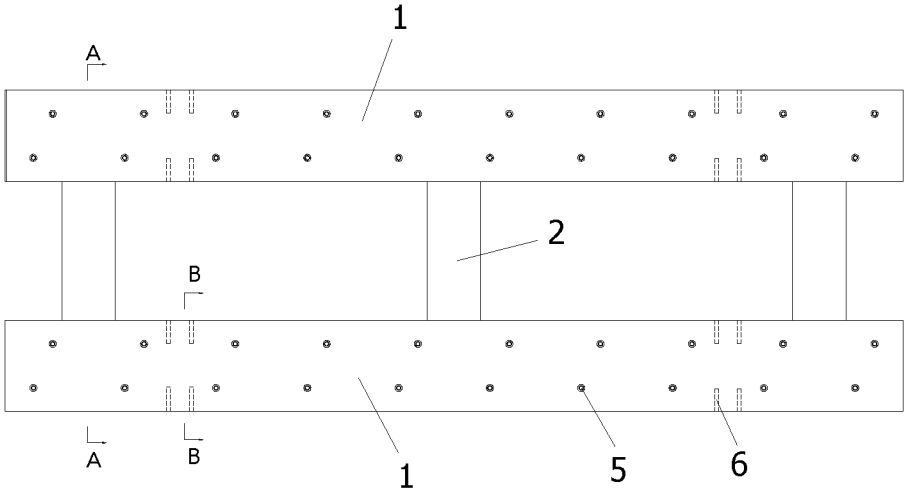
FIG. 2 is the top view of the longitudinal sleeper.
Figure 3:
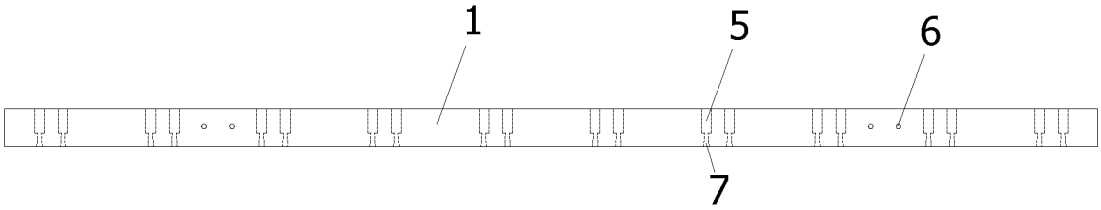
FIG. 3 is the side view of the longitudinal sleeper.
Figure 4:
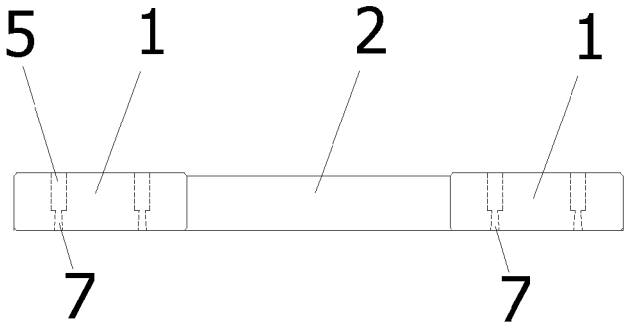
FIG. 4 is the A-A sectional view of FIG. 2.

As shown in FIG. 1 and FIG. 2, according to an embodiment of the present invention, there is provided a longitudinal sleeper comprising a pair of longitudinal prestressed concrete beams 1 to be positioned under the rail and arranged longitudinally along the rail, and further comprising a concrete connection board 2 being transversely connected between the pair of longitudinal prestressed concrete beams 1. The numerical number 6 in FIG. 2 indicates a lifting hole, through which the longitudinal sleeper can be hoisted by a crane for laying and maintenance, and an auxiliary bracket used in construction can be installed, etc.

The pair of longitudinal prestressed concrete beams 1 may be laid onto the ballast track bed or ballastless track bed, onto which the rail may be laid. The concrete connection board 2 is connected between the pair of longitudinal prestressed concrete beams 1 for keeping the stability of the longitudinal sleeper and the rail gauge between the pair of longitudinal beams 1.

The height and thickness of the longitudinal prestressed concrete beam 1 are basically identical with that of the concrete connection board 2. The width of the concrete connection board 2 may be designed according to load and rigidity requirements, usually may be ⅖~⅗ of the width of a single longitudinal beam 1, but the present invention is not limited hereto.

As shown in FIG. 1, three concrete connection boards 2 are arranged between the pair of longitudinal prestressed concrete beams 1. For various requirements, the quantity of the concrete connection boards 2 may be 1, 2 or more than 3, the present invention gives no limitation hereto. To ensure the longitudinal sleeper have stable structure and bear balanced load, it is preferred to symmetrically arrange the whole longitudinal sleeper along the center line of its length direction.

In the present invention, since the prior steel pipe between the longitudinal prestressed concrete beams 1 is replaced by the concrete connection board 2 as the connector, the problems of the steel pipe such as interference with electrical signal and corrosion due to long-period exposure can be thoroughly solved. The pair of longitudinal prestressed concrete beams 1 and the concrete connection board 2 may be formed integrally by pouring, for example, integrally poured in a factory, so it is easy to be manufactured, has high production efficiency, and is favorable for construction. For the prior steel pipe type connectors, when making the longitudinal sleeper, the connection between the steel pipe and the longitudinal prestressed concrete beams must be considered. In this embodiment, because the longitudinal prestressed concrete beams 1 and the concrete connection board 2 are poured integrally, so it is not necessary to consider all the problems in relation to the connection therebetween, and the longitudinal sleeper is simple in structure, convenient in construction, and effectively reduced in the manufacture cost.

A plurality of pre-tensioned rebar (short for reinforcing bar) are arranged in the longitudinal prestressed concrete beam 1 and the concrete connection board 2 so as to increase the strength and rigidity of the longitudinal sleeper. For the longitudinal prestressed concrete beam 1, it may have the structure similar to the prior longitudinal beam of the existing "trapezoidal sleeper" or "longitudinal sleeper", in which a plurality of pre-tensioned rebar may be arranged. For the concrete connection board 2 of the present invention, it is also possible to arrange a plurality of pre-tensioned rebar thereinto so as to increase the strength and rigidity of the concrete connection board 2, which will be described in details later.

In the longitudinal sleeper, an embedded sleeve is often provided in the longitudinal prestressed concrete beam for connection with a fastener so that the rail can be mounted onto the longitudinal sleeper to complete the laying of the railway track. The material of embedded sleeve in the longitudinal prestressed concrete beam is quite different from the concrete, and the linear expansion coefficient thereof may be quite different. In a traditional longitudinal sleeper, when the relative space for fixing the lower part of an anchorage bolt of the fastener with the lower part of the embedded sleeve is relatively small (for example, if there is water accumulation), due to the different extent of thermal expansion and contraction, a great stress may be produced, which may damage the bottom of the embedded sleeve and transfer the force into the longitudinal prestressed concrete beam. When a great stress transferred into the longitudinal sleeper, if it can't be relieved immediately, the longitudinal beam may be accordingly fractured and damaged, which may give potential damage to the longitudinal sleeper. So, especially in area with high temperature change, during construction or later usage, the foreign matters and rainwater etc may easily enter the embedded sleeve, which, due to the temperature change, may cause stress in the longitudinal prestressed concrete beam and lead to fracture and damage to the longitudinal beam.

Figure 5:
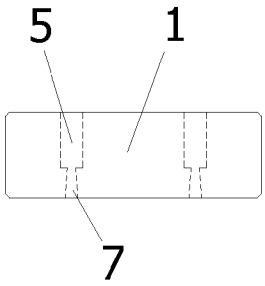
FIG. 5 is the B-B sectional view of FIG. 2.

To solve this technical problem, according to an embodiment of the present invention, as shown in FIG. 5, an opening is provided at the lower end of the embedded sleeve 5, and communicates with the through-hole 7 in the longitudinal beam. This through-hole 7 communicates the opening at the lower end of the embedded sleeve 5 to the place under the longitudinal prestressed concrete beam 1. In other embodiments, this through-hole 7 may also communicate to a side of the longitudinal prestressed concrete beam 1. In this embodiment, with the through-hole 7 provided in the longitudinal prestressed concrete beam 1, the embedded sleeve 5 with the lower opening is communicated to the outside, thus the stress in the longitudinal prestressed concrete beam 1 may be relieved by the through-hole 7, avoid arising of fracture and damages. In addition, all foreign matters and water accumulation etc in the embedded sleeve 5 with the lower opening may be flown out from the through-hole 7 to the outside of the longitudinal prestressed concrete beam 1, so as to avoid foreign matters and water accumulating in the longitudinal prestressed concrete beam 1, effectively avoid fracture of the longitudinal prestressed concrete beam 1 under the effect of temperature varying, especially the fracture in low temperature environment.

As shown clearly from FIG. 5, the diameter of said through-hole 7 maybe enlarged outward gradually, which is favorable for fabricating the longitudinal prestressed concrete beam 1, that is, during the fabricating process, the core forming the through-hole 7 may be easy to withdraw from the through-hole 7. In other words, the through-hole 7 has a withdrawing inclining angle which is favorable for fabrication. In addition, in order to successfully drain out the foreign matters and water accumulation in the embedded sleeve 5, the outlet of the through-hole 7 extended out of the longitudinal prestressed concrete beam 1 is preferably unblocked.

As shown in FIG. 1 and FIG. 2, during the production of the prestressed concrete sleeper, the stress concentration is easily formed at the connection corner between the concrete connection board 2 and the longitudinal prestressed concrete beam 1. Moreover, after the damping railway system comprising this longitudinal sleeper used for a period of time, especially for the ballast track bed, due to friction and non-uniform support etc, the stress shall be progressively accumulated and increased in the longitudinal prestressed concrete beam 1, finally cause the longitudinal beam 1 fractured and damaged, seriously reduce the safety and service life of the damping railway system, increase its maintenance and repair cost.

Figure 6:
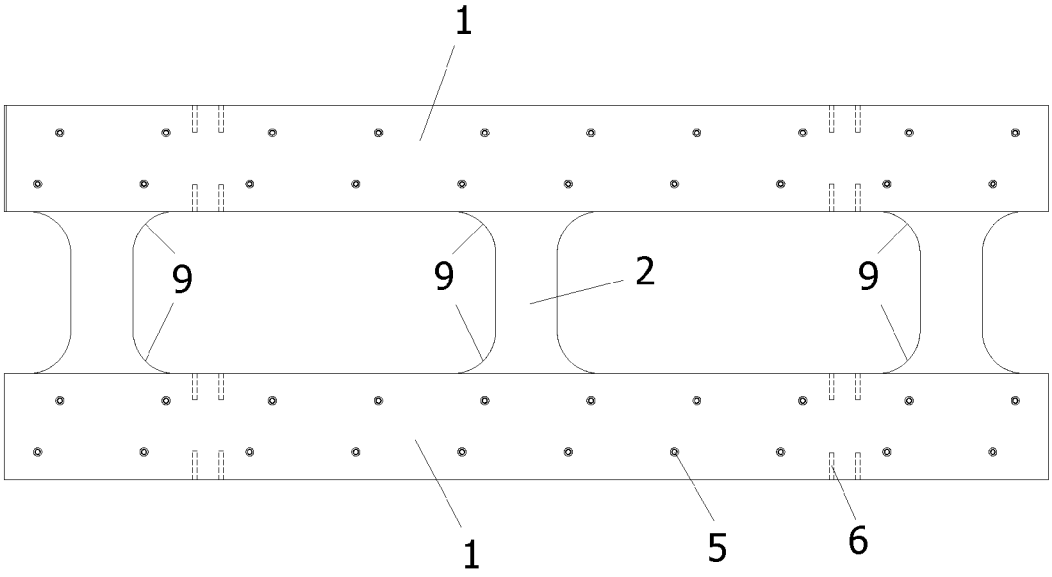
FIG. 6 to FIG. 9 are the plan views of the longitudinal sleeper according to other embodiments of the present invention.

FIG. 6 is a top view of a longitudinal sleeper according to another embodiment of the present invention. Especially for the ballastless track, to solve the problems of the longitudinal beam fractured and damaged due to stress concentration, as shown in FIG. 6, a round corner 9 may be formed at the connection corner between the concrete connection board 2 and the longitudinal prestressed concrete beam 1. Moreover, it is possible to make some adjustments for the arrangement of rebars in the connection board, for example, adding a crack resistant auxiliary rebar 15, thus eliminate the fracture caused by stress concentration at the connection corner.

Figure 7:
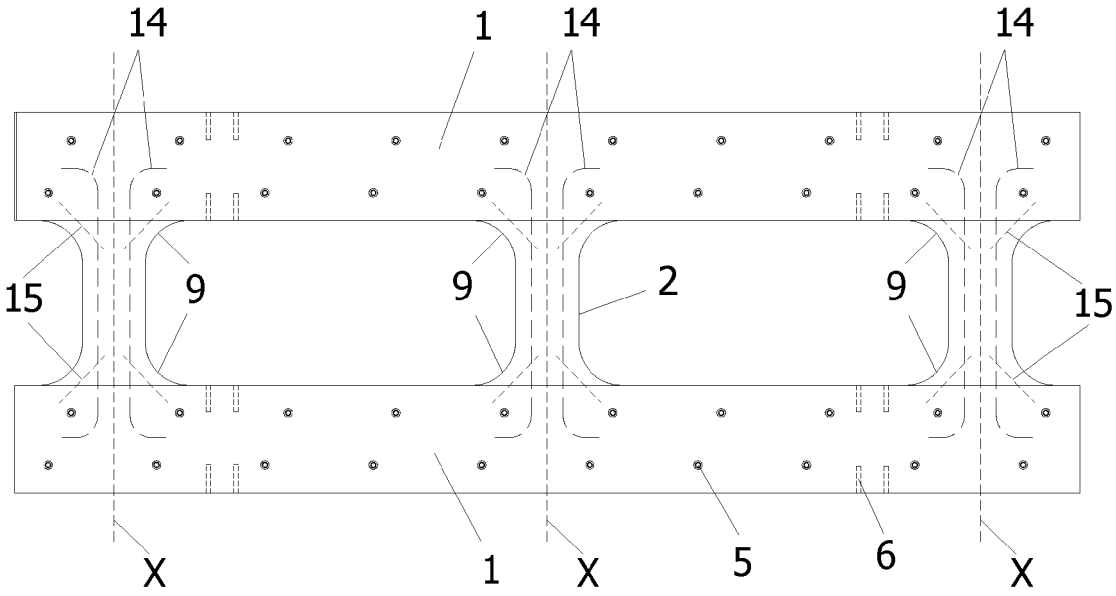

FIG. 7 is a plane view of a longitudinal sleeper according to an embodiment of the present invention. As shown in FIG. 7, at least a pair of reinforcement rebars 14 may be arranged in the concrete connection board 2 at both sides of the center line X thereof, both ends of the rebar 14 respectively extend into the longitudinal prestressed concrete beam 1, and bent outward relative to the center line X (that is, both ends of a pair of rebar 14 bent opposite along the length direction of the longitudinal beam). In this embodiment, both ends of the rebar 14 bent outward may avoid the stress produced at the ends; in addition, the tensile strength of the rebar 14 can be increased, and then the strength and rigidity of the concrete connection board 2 can be increased. Besides, after both ends of the rebar 14 bent outward, they can re-bent to each other again, or further bent back afterwards, which may be designed based on the actual requirements, the invention has no limitations hereof. In addition, as an example, the rebar 14 may use the Φ51 cm spiral ribbed bar. The rebar with relative large diameter may effectively increase the strength and rigidity of the concrete connection board 2; meanwhile reduce the dimension of the concrete connection board. The spiral rib formed on the exterior of the rebar may increase the anti-withdrawing performance, so that the rebar 14 and the concrete connection board 2 as well as the longitudinal prestressed concrete beam 1 can be more firmly combined together. This longitudinal sleeper effectively can solve the stress concentration of concrete members, and solve the problem of reasonable strength and rigidity of the concrete connection board for replacing the steel pipe as connector. So this longitudinal sleeper may be suitable for ballastless track bed high speed railway, for example, up to 300 km/h, and even more.

Figure 8:
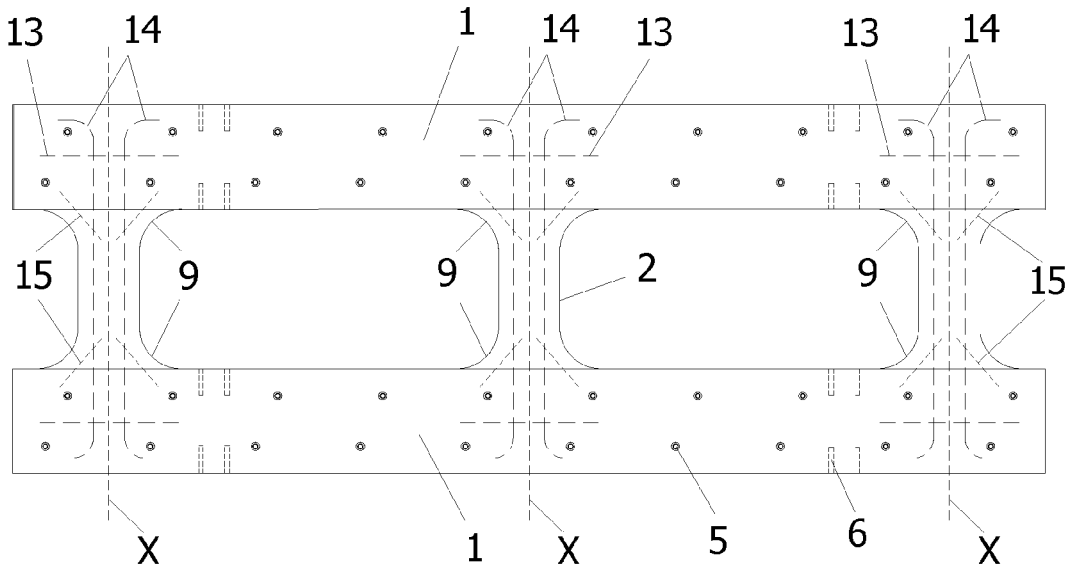

FIG. 8 is a plane view of a longitudinal sleeper according to another embodiment of the present invention. As shown in FIG. 8, compared with that of FIG. 7, the difference of this embodiment is the longitudinal prestressed concrete beam 1 has the additional connecting rebar 13. In details, outer of both ends of each concrete connection board 2, in the longitudinal prestressed concrete beam 1, the connecting rebar 13 is connected with at least a pair (e.g., two pieces) of reinforcement rebar 14 extended from the concrete connection board 2, it is preferred to weld, thus further improve the anti-withdrawing performance of the reinforcement rebar 14.

Figure 9:
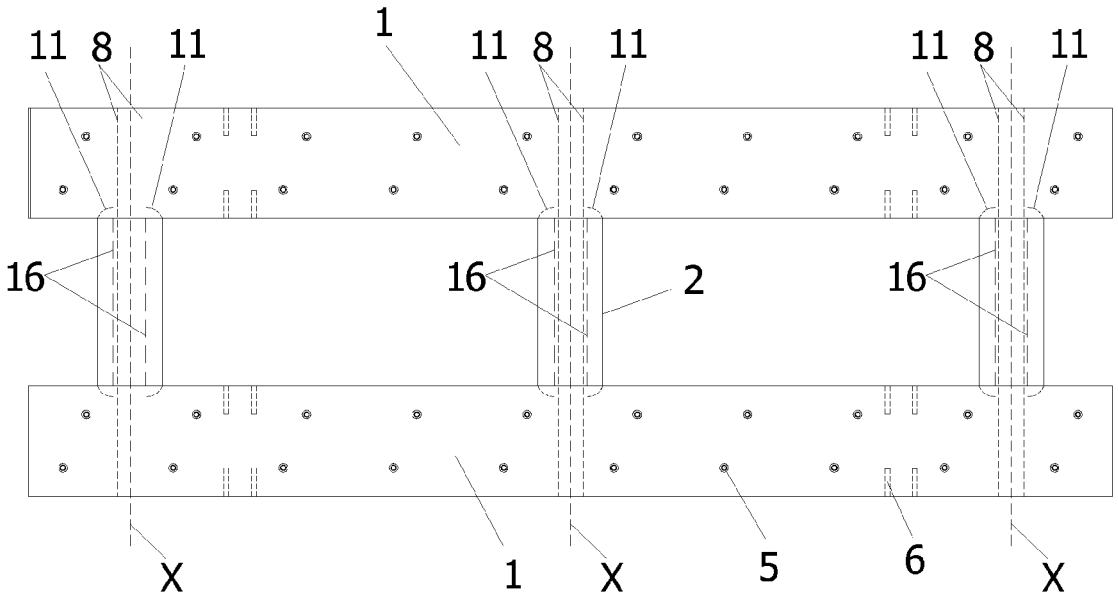

FIG. 9 is a plan view of a longitudinal sleeper according to another embodiment of the present invention. As said above, during the production of the prestressed concrete member, it is easy to produce the stress concentration at the connection corner between the longitudinal prestressed concrete beam 1 and the concrete connection board 2, which may cause the longitudinal beam 1 fractured and damaged. In addition, after the railway track being used for a long period of time, especially used on ballast track bed, the friction stress and non-uniform force caused by non-uniform supports may be formed on the longitudinal prestressed concrete beam 1. If the stress is not relieved and controlled, the fracture and damages to the longitudinal prestressed concrete beam 1 shall be worsened, give great effect to service life and running safety of the railway track. In this embodiment, a stress release crack 11 may be formed in advance near the connection corner between the longitudinal prestressed concrete beam 1 and the concrete connection board 2, which, on one hand, can relieve the stress formed during the manufacture, on the other hand, can relieve the fatigue stress formed during operation, thus effectively eliminate the fracture on the longitudinal prestressed concrete beam, prolong the service life and running safety of the railway track.

In the present invention, the above stress release crack 11 may be formed in various manners. As shown in FIG. 9, at least a pair of structural rebar 16 may be arranged at both sides of the center line X of the concrete connection board 2, and symmetrically arranged in the concrete connection board 2. Generally, in a concrete connection board 2, two pairs of structural rebars 16 may be arranged, in which, one pair is arranged at the upper part of the connection board 2, and the other pair is arranged at the lower part of the connection board 2. In this embodiment, in a concrete connection board 2, only one pair of structural rebars 16, or more than two pairs of structural rebars 16 may be arranged, the present invention shall give no limitation hereof.

Both ends of each structural rebar 16 are respectively extended to the location near the ends of the concrete connection board 2, that is, near the brim of the pair of longitudinal prestressed concrete beam 1, thus form a stress concentration around it. Meanwhile, due to stress concentration will also be produced at the connection corner between the concrete connection board 2 and the longitudinal prestressed concrete beam 1, so the stress release crack 11 extended between both positions may be formed to relieve the stress in the longitudinal prestressed concrete beam 1.

To avoid the fracture of the stress release crack 11 on the longitudinal prestressed concrete beam 1, ensure the quality of product, at least a pair of post-tensioned rebars 8 may be extended and arranged in the concrete connection board and the longitudinal prestressed concrete beam. As a preferred embodiment, for each concrete connection board, two post-tensioned rebars 8 may be symmetrically arranged at both sides of the concrete connection board 2 along its center line X to realize the uniform loading.

After the longitudinal sleeper poured, a screw member is used to adjust the tension of the post-tensioned rebar 8 to be higher than the stress of the stress release crack 11, so as to keep the stress release crack 11 in a closed state, that is, avoid the fracture of the stress release crack 11. The strength of the post-tensioned rebar 8 usually depends on the load and rigidity of the connection board 2, usually the Φ13 cm prestressed rebar may be used. The detailed structure and arrangement of the post-tensioned rebar 8 is known to a person skilled in the art, detailed description is omitted here.

According to a preferred embodiment, the stress release crack 11 may be formed on the upper surface and/or lower surface of the longitudinal prestressed concrete beam 1; preferably on the lower surface for its non-contact with the rail.

When the structural rebar 16 is arranged in the concrete connection board 2, it prefers to arrange the post-tensioned rebar 8 at the inner side of the structural rebar, thus effectively avoid the fracture of the stress release crack 11 and keep it in a closed state.

In an embodiment of the present invention, as shown in FIG. 7 to FIG. 9, at least a pair of crack resistant auxiliary rebars 15 may be arranged inside the connection corner between the concrete connection board 2 and the longitudinal prestressed concrete beam 1, symmetrically arranged at both sides of the center line X of the concrete connection board 2, and inclined to the center line X, thus avoid arising of fracture at the connection corner.

The inclined angle between the crack resistant auxiliary rebar and the center line X may be 30° to 60°, but the present invention is not limited hereto.

Some embodiments of the longitudinal sleeper in the present invention have been described in detail above, but the present invention includes but not limits hereto. Moreover, it should be noted that the above embodiments of the present invention may be combined in various feasible ways. All these feasible combinations may be deemed as a part of the present invention disclosure and also within the range of the present invention.

According to another aspect of the present invention, there is provided a damping railway system comprising the longitudinal sleeper of the present invention. Now the embodiment of the damping railway system shown in FIG. 10 and FIG. 11 shall be described in details as followings.

Figure 10:
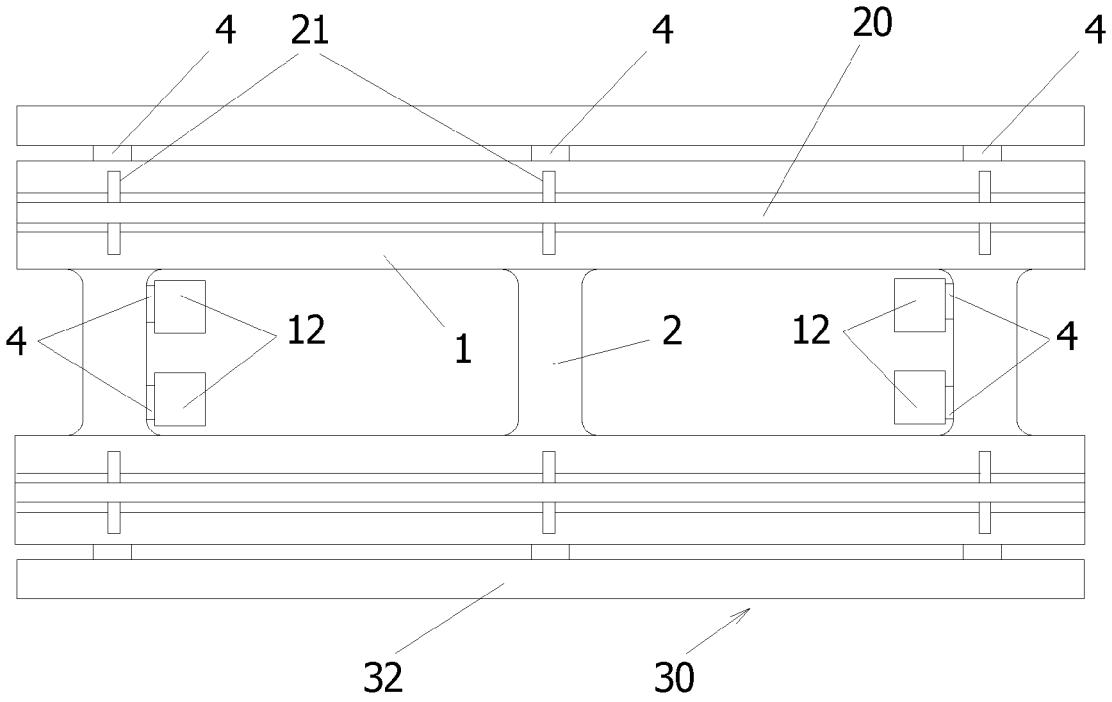
FIG. 10 is the plan view of a damping railway system according to an embodiment of the present invention.
Figure 11:
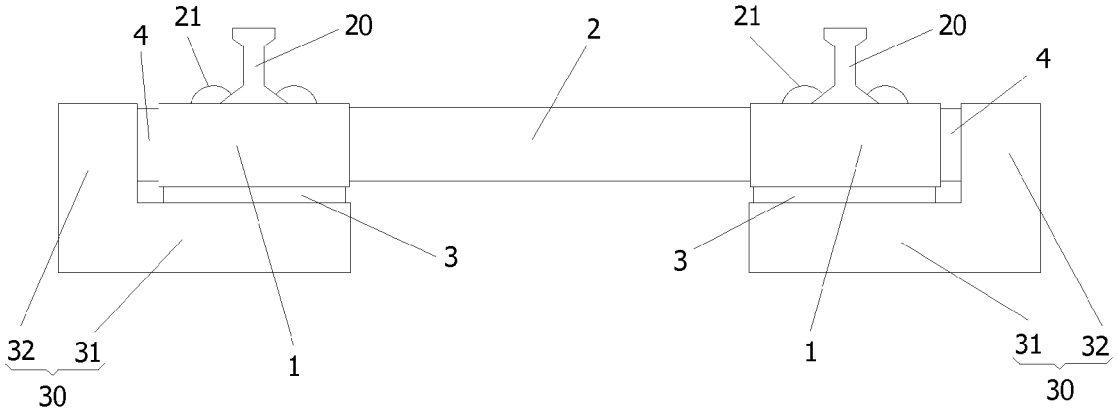
FIG. 11 is the side view of the damping railway system shown in FIG. 10.

FIG. 10 is a plan view of a damping railway system according to an embodiment of the present invention. FIG. 11 is a side view of the damping railway system shown in FIG. 10.

As shown in FIG. 10 and FIG. 11, the damping railway system comprises the longitudinal sleeper, and rail 20 installed onto the pair of longitudinal prestressed concrete beams 1 in the longitudinal sleeper along the length direction of the longitudinal sleeper respectively. The length direction herein means the length direction of the damping railway system, and also the length direction of the longitudinal prestressed concrete beam and rail, because the sleeper of the present invention belongs to a "longitudinal sleeper". Generally speaking, by combining the fastener 21 with the embedded sleeve 5 in the longitudinal prestressed concrete beam 1, the rail 20 can be installed onto the longitudinal prestressed concrete beam 1. According to an embodiment of the present invention, the damping railway system may comprise a L-type concrete bearing 30 with bottom part 31 and side part 32, that is, the bottom part 31 and side part 32 of the bearing 30 are wholly formed in a L-shape. The longitudinal prestressed concrete beam 1 sits on the bottom part 31 of the bearing 30, with its outer side against the side part 32 of the bearing 30. Through this L-type concrete bearing 30, it can not only support the longitudinal prestressed concrete beam 1, but also can provide the transverse limitation for the longitudinal sleeper or the damping railway system. It should be noted that the L-shaped concrete bearing 30 is only an embodiment used to the longitudinal sleeper. The present invention includes but not limits to, for example, an iron casting bearing.

According to an embodiment of the present invention, a shock-absorbing pad 3 may be placed between the longitudinal prestressed concrete beam 1 and the bottom part 31 of the bearing 30, and a buffer pad 4 may be arranged between the longitudinal prestressed concrete beam 1 and the side part 32 of the bearing 30 to realize the shock-absorbing and buffer effects, reduce the impact of rail vibration to the structure, and prolong the service life of the structure. Meanwhile, according to the principle of acting force and counteracting force, similarly, the impact on damping railway system may be reduced too. For a damping railway system, the shock-absorbing pad and buffer pad may lower the force suffered. Moreover, due to longitudinal sleeper used for longitudinal distributing of forces on wheel and rail, so the impact acting on the whole damping railway system is lower. The shock-absorbing pad 3 and the buffer pad 4 may be made of various elastic materials, for example, rubber, plastics, and spring etc. In addition, in the present invention, other dampers may be also used for replacing the shock-absorbing materials and/or buffer materials. The damper usually comprises at least two plates and spring between the plates. For a person skilled in the art, its structure is well known and no further description is given in the present invention.

According to an embodiment of the present invention, a plurality of piers 12 may be arranged at an interval at the inner side of the longitudinal prestressed concrete beam; this pier 12 is leaned against the concrete connection board 2. In details, the pier 12 is independently formed at the inner side of the longitudinal prestressed concrete beam 1 and spaced apart from the longitudinal prestressed concrete beam 1 (the space therebetween may be filled with a buffer pad 4, or directly reserved), to avoid direct transferring of vibration from the longitudinal prestressed concrete beam 1 to the pier 12. In addition, the pier 12 leans against the concrete connection board 2 to realize the climb-prevention of the longitudinal sleeper during the running of a train thereon. Moreover, by arrangement of the pier 12 inside the longitudinal prestressed concrete beam 1, ensure that the damping railway system can be easily laid at a restrictive area outside, for example, at the tunnel, and bridge etc. Generally, the pier 12 may be cast-in-place, and the fixing of the pier 12 with the ground, for example, may be realized through embedded steel rebar or later-planted steel rebar. It is preferred to arrange the buffer pad between the concrete connection board and the pier, this buffer pad is favorably made of elastic materials.

Several embodiments of the present invention above give detailed description to the damping railway system, which may generally adopt the various longitudinal sleepers mentioned in the present invention.

It should be stressed that the longitudinal sleeper and damping railway system have been described in details according to attached figures and several embodiments, but the present invention includes but not limits to these embodiments, and these embodiments may be used by various feasible combinations, this invention shall give no limit hereof. For example, the pier 12 shown in FIG. 10 may be used for various longitudinal sleepers in this invention, such as the longitudinal sleeper shown in FIG. 1, or a longitudinal sleeper shown in FIG. 6 to FIG. 9. All these feasible combinations shall be deemed as a part of this invention disclosure, and also within the protection scope of this invention.

What is claimed is:

1. A longitudinal sleeper, comprising a pair of longitudinal prestressed concrete beams respectively to be positioned longitudinally under a rail and a concrete connection board connected transversely between the pair of longitudinal prestressed concrete beams, wherein the pair of longitudinal prestressed concrete beams and the concrete connection board are formed integrally by pouring, and a stress release crack is formed on one or both of the longitudinal prestressed concrete beams near the joint portion between the respective beam and the concrete connection board and in one or more of an upper surface or a lower surface of the respective beam.

2. The longitudinal sleeper according to claim 1, wherein the concrete connection board is one of a plurality of the concrete connection boards arranged at an interval along the length direction of the longitudinal prestressed concrete beams.

3. The longitudinal sleeper according to claim 1, wherein at least one of the longitudinal prestressed concrete beams is provided therein with an embedded sleeve extending downward from its upper surface, and a through-hole continuously extending from the bottom of the embedded sleeve downward to the outside of the longitudinal prestressed concrete beam.

4. The longitudinal sleeper according to claim 1, wherein a connection corner between both sides of the concrete connection board and at least one of the longitudinal prestressed concrete beams is formed into a round corner.

5. The longitudinal sleeper according to claim 4, wherein the concrete connection board includes a center line, and a pair of reinforcement rebars are symmetrically arranged in the concrete connection board at both sides of the center line, both ends of each of the pair of reinforcement rebars are respectively extended into one of the longitudinal prestressed concrete beams and bent outward relative to the center line.

6. The longitudinal sleeper according to claim 5, wherein connecting rebar is disposed in both of the longitudinal prestressed concrete beams and connected with the reinforcement rebars.

7. The longitudinal sleeper according to claim 1, wherein the concrete connection board includes a center line, and a pair of structural rebars are symmetrically arranged in the concrete connection board at both sides of the center line.

8. The longitudinal sleeper according to claim 7, wherein a pair of post-tensioned rebars are symmetrically arranged in the concrete connection board at both sides of the center line, both ends of each are extended to an outside surface of the longitudinal prestressed concrete beam.

9. The longitudinal sleeper according to claim 8, wherein the post-tensioned rebars are positioned inside the structural rebars.

10. The longitudinal sleeper according to claim 1, wherein the concrete connection board includes a center line, and a pair of crack resistant auxiliary rebars are arranged at an inner side of a connection corner between the concrete connection board and at least one of the longitudinal prestressed concrete beams, symmetrically arranged at both sides of the center line of the concrete connection board, and slantly arranged relative to the center line.

11. The longitudinal sleeper according to claim 10, wherein, the inclined angle between the crack resistant auxiliary rebar and the center line is 30°-60°.

12. A damping railway system comprising a longitudinal sleeper, the longitudinal sleeper comprising a pair of longitudinal prestressed concrete beams respectively to be positioned longitudinally under a rail, a concrete connection board connected transversely between the pair of longitudinal prestressed concrete beams, wherein the pair of longitudinal prestressed concrete beams and the concrete connection board are formed integrally by pouring, and a stress release crack is formed on one or both of the longitudinal prestressed concrete beams near the joint portion between the respective beam and the concrete connection board and in one or more of an upper surface or a lower surface of the respective beam, and the rail is installed onto the pair of longitudinal prestressed concrete beams in the longitudinal sleeper along the length direction of the longitudinal sleeper.

13. The damping railway system according to claim 12, wherein at least one of the longitudinal prestressed concrete beams is provided therein with an embedded sleeve extended downward from its upper surface, and a through-hole continuously extending from the bottom of the embedded sleeve downward to the outside of the longitudinal prestressed concrete beam and, wherein by combining a fastener with the embedded sleeve in the longitudinal prestressed concrete beam, the rail is installed onto the longitudinal prestressed concrete beam.

14. The damping railway system according to claim 12, wherein the damping railway system further comprises at least one bearing on which a respective one of the longitudinal prestressed concrete beams is installed, and wherein the bearing has an L-shape with a bottom part and a side part, the respective longitudinal prestressed concrete beam sits on the bottom part of the bearing, and an outside of the respective longitudinal prestressed concrete beam leans against the side part of the bearing.

15. The damping railway system according to claim 14 further comprising a shock-absorbing pad or a damper arranged between the longitudinal prestressed concrete beam and the bottom part of one or more of a bearing or a buffer pad arranged between the longitudinal prestressed concrete beam and the side part of the bearing.

16. The damping railway system according to claim 12, wherein a pier is disposed at the inner side of at least one of the longitudinal prestressed concrete beam, spaced apart from the beam, and abutting against the concrete connection board.

17. The damping railway system according to claim 16, wherein a buffer pad is placed between the concrete connection board and the pier.

* * * * *